US006405828B1

(12) United States Patent
Redding

(10) Patent No.: US 6,405,828 B1
(45) Date of Patent: Jun. 18, 2002

(54) PROTECTIVE LADDER ATTACHMENT

(76) Inventor: William A. Redding, 304 W. Summit Ave., Wilmington, DE (US) 19804

( * ) Notice: Subject to any disclaimer, the term of this patent is extended or adjusted under 35 U.S.C. 154(b) by 0 days.

(21) Appl. No.: 09/653,848

(22) Filed: Sep. 1, 2000

(51) Int. Cl.[7] ..... E04G 5/02; E06C 7/06
(52) U.S. Cl. ..... 182/107; 182/214
(58) Field of Search ..... 182/107, 108, 182/214, 111; 248/210, 238

(56) References Cited

U.S. PATENT DOCUMENTS

| | | | | |
|---|---|---|---|---|
| 1,502,490 A | | 7/1924 | Tack | |
| 2,904,128 A | | 9/1959 | Boham et al. | |
| 2,993,562 A | * | 7/1961 | Hussey | 182/214 |
| 3,486,580 A | * | 12/1969 | Nameche et al. | 182/214 |
| D265,592 S | | 7/1982 | Perkins | |
| 4,339,020 A | * | 7/1982 | Wiseman | 182/214 |
| 4,369,860 A | | 1/1983 | Beane | |
| 4,444,291 A | * | 4/1984 | Mc Pherson | 182/214 |
| 4,643,274 A | * | 2/1987 | Tataseo | 182/214 X |
| 4,754,842 A | | 7/1988 | Southern | |
| 5,165,501 A | * | 11/1992 | Donahey | 182/214 |
| 5,165,641 A | | 11/1992 | Southern | |
| 5,743,356 A | * | 4/1998 | Mitchell | 182/214 |
| 5,941,343 A | * | 8/1999 | Kelsey | 182/107 |
| 6,158,551 A | * | 12/2000 | Gray | 182/107 |

* cited by examiner

*Primary Examiner*—Daniel P. Stodola
*Assistant Examiner*—Hugh B. Thompson

(57) ABSTRACT

A protective ladder attachment for protecting the wall structure against which the ladder is leaning. The protective ladder attachment includes an elongate brace member having a first side and a second side; and also includes a protective padded cover securely attached to the second side of the elongate brace member and being adapted to rest against a wall structure; and further includes bracket members being spaced apart and securely attached to the first side of the elongate brace member; and also includes an attachment assembly for removably attaching the elongate brace member to a ladder.

4 Claims, 2 Drawing Sheets

PROTECTIVE LADDER ATTACHMENT

BACKGROUND OF THE INVENTION

1. Field of the Invention

The present invention relates to a ladder standoff device and more particularly pertains to a new protective ladder attachment for protecting the wall structure against which the ladder is leaning.

2. Description of the Prior Art

The use of a ladder standoff device is known in the prior art. More specifically, a ladder standoff device heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,754,842; U.S. Pat. No. 5,165,641; U.S. Pat. No. 1,502,490; U.S. Pat. No. Des. 265,592; U.S. Pat. No. 4,369,860; and U.S. Pat. No. 2,904,128.

While these devices fulfill their respective, particular objectives and requirements, the aforementioned patents do not disclose a new protective ladder attachment. The inventive device includes an elongate brace member having a first side and a second side; and also includes a protective padded cover securely attached to the second side of the elongate brace member and being adapted to rest against a wall structure; and further includes bracket members being spaced apart and securely attached to the first side of the elongate brace member; and also includes an attachment assembly for removably attaching the elongate brace member to a ladder.

In these respects, the protective ladder attachment according to the present invention substantially departs from the conventional concepts and designs of the prior art, and in so doing provides an apparatus primarily developed for the purpose of protecting the wall structure against which the ladder is leaning.

SUMMARY OF THE INVENTION

In view of the foregoing disadvantages inherent in the known types of ladder standoff device now present in the prior art, the present invention provides a new protective ladder attachment construction wherein the same can be utilized for protecting the wall structure against which the ladder is leaning.

The general purpose of the present invention, which will be described subsequently in greater detail, is to provide a new protective ladder attachment which has many of the advantages of the ladder standoff device mentioned heretofore and many novel features that result in a new protective ladder attachment which is not anticipated, rendered obvious, suggested, or even implied by any of the prior art ladder standoff device, either alone or in any combination thereof.

To attain this, the present invention generally comprises an elongate brace member having a first side and a second side; and also includes a protective padded cover securely attached to the second side of the elongate brace member and being adapted to rest against a wall structure; and further includes bracket members being spaced apart and securely attached to the first side of the elongate brace member; and also includes an attachment assembly for removably attaching the elongate brace member to a ladder.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new protective ladder attachment which has many of the advantages of the ladder standoff device mentioned heretofore and many novel features that result in a new protective ladder attachment which is not anticipated, rendered obvious, suggested, or even implied by any of the prior art ladder standoff device, either alone or in any combination thereof.

It is another object of the present invention to provide a new protective ladder attachment which may be easily and efficiently manufactured and marketed.

It is a further object of the present invention to provide a new protective ladder attachment which is of a durable and reliable construction.

An even further object of the present invention is to provide a new protective ladder attachment which is susceptible of a low cost of manufacture with regard to both materials and labor, and which accordingly is then susceptible of low prices of sale to the consuming public, thereby making such protective ladder attachment economically available to the buying public.

Still yet another object of the present invention is to provide a new protective ladder attachment which provides in the apparatuses and methods of the prior art some of the advantages thereof, while simultaneously overcoming some of the disadvantages normally associated therewith.

Still another object of the present invention is to provide a new protective ladder attachment for protecting the wall structure against which the ladder is leaning.

Yet another object of the present invention is to provide a new protective ladder attachment which includes an elongate brace member having a first side and a second side; and also includes a protective padded cover securely attached to the second side of the elongate brace member and being adapted to rest against a wall structure; and further includes bracket members being spaced apart and securely attached to the first side of the elongate brace member; and also includes an attachment assembly for removably attaching the elongate brace member to a ladder.

Still yet another object of the present invention is to provide a new protective ladder attachment that prevents a wall structure from being marred by a ladder.

Even still another object of the present invention is to provide a new protective ladder attachment that is easy and convenient to mount to a ladder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
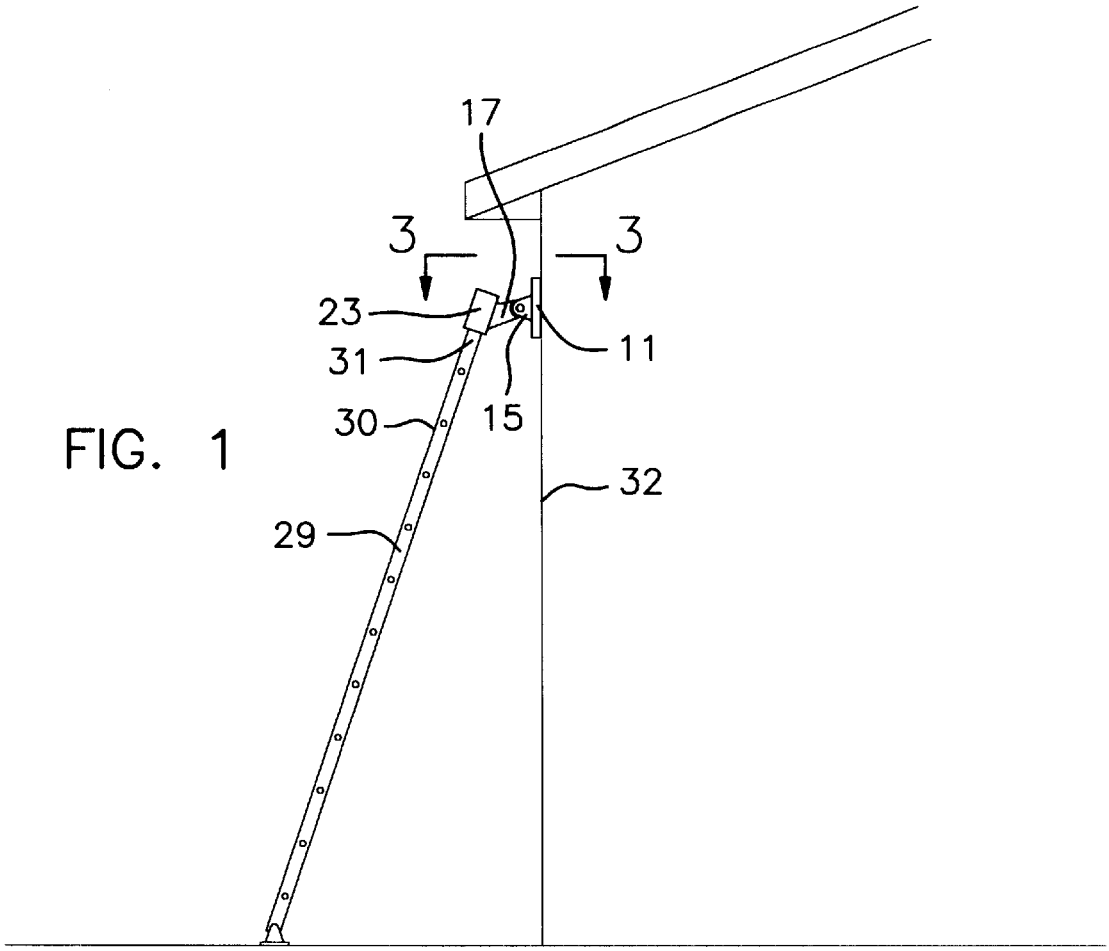
FIG. 1 is a side elevation view of a new protective ladder attachment according to the present invention shown in use.
Figure 2:
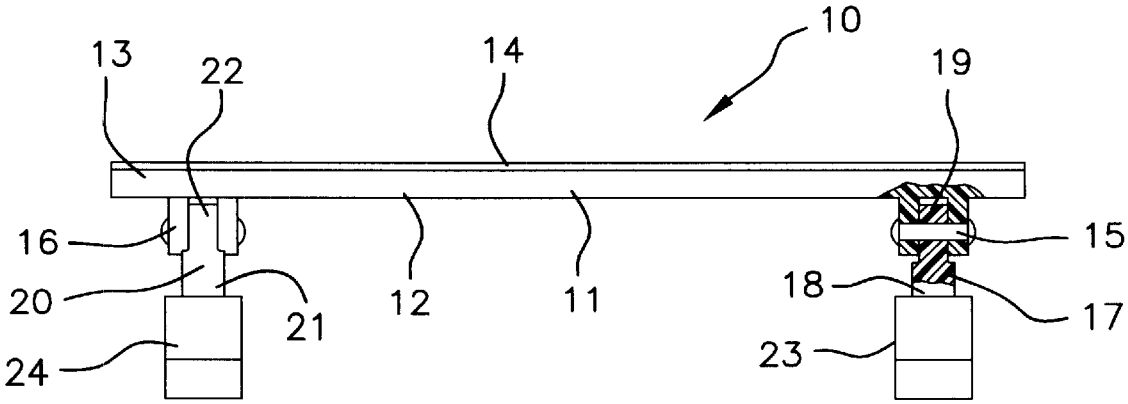
FIG. 2 is a top plan view of the present invention.
Figure 3:
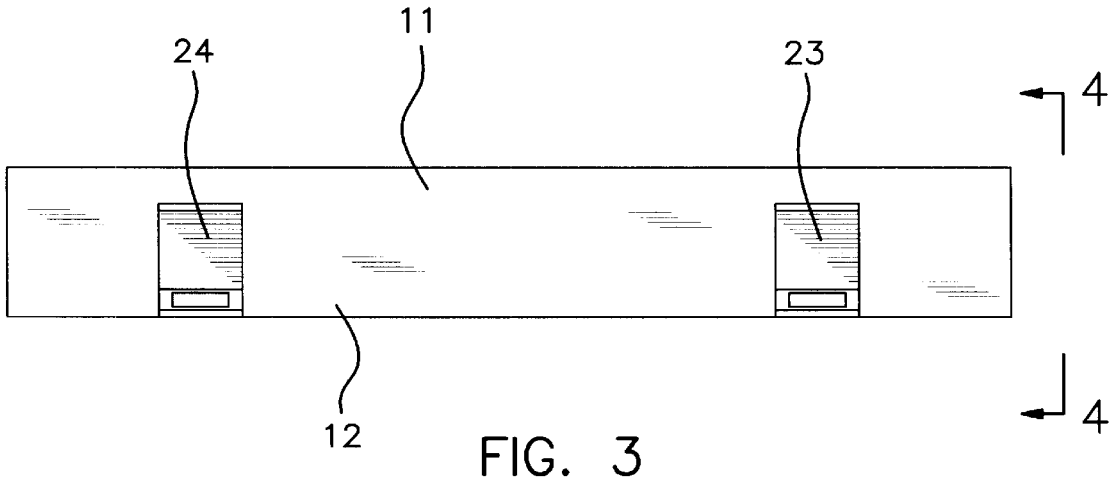
FIG. 3 is a front elevational view of the present invention.
Figure 4:
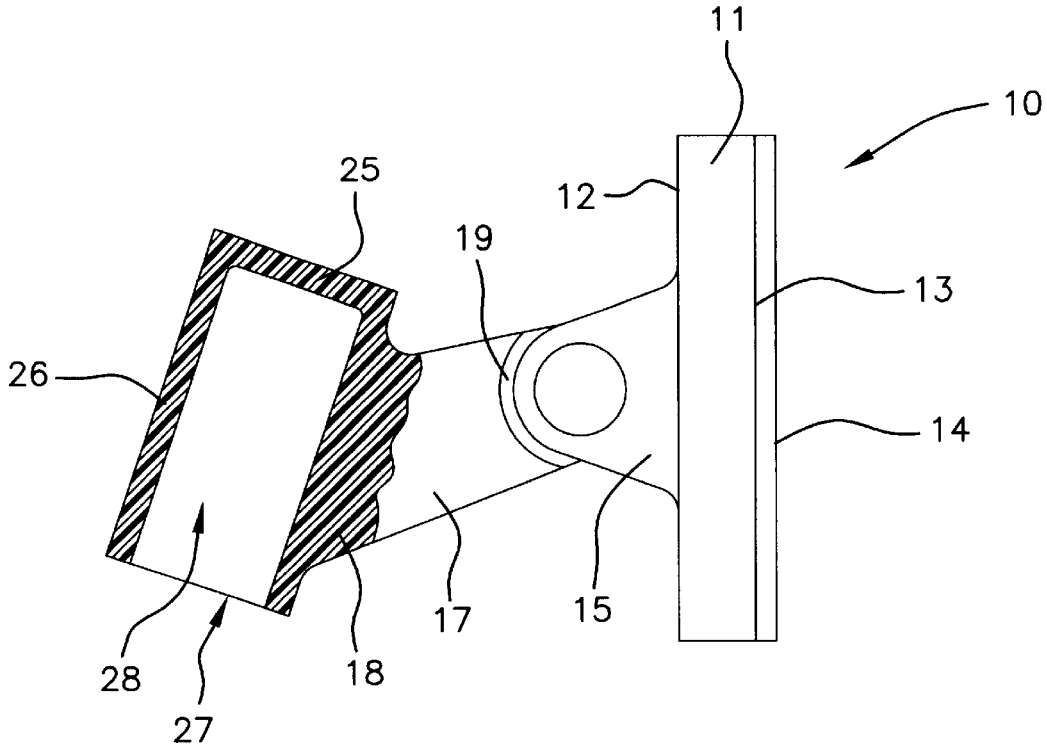
FIG. 4 is a detailed side elevational view of the present invention.

With reference now to the drawings, and in particular to FIGS. 1 through 4 thereof, a new protective ladder attachment embodying the principles and concepts of the present invention and generally designated by the reference numeral 10 will be described.

As best illustrated in FIGS. 1 through 4, the protective ladder attachment 10 generally comprises an elongate brace member 11 having a first side 12 and a second side 13 and further having a length of approximately 24 inches, and a width of approximately 8 inches and a depth of approximately 8 inches. A protective padded cover 14 is securely and conventionally attached to the second side 13 of the elongate brace member 11 and is adapted to rest against a wall structure 32 with the protective padded cover 14 being essentially made of a rubber material for substantially preventing any damage to the wall structure 32. Bracket members 15,16 are spaced apart and securely and conventionally attached and welded to the first side 12 of the elongate brace member 11. Means for removably attaching the elongate brace member 11 to a ladder 29 includes arm members 17,20 each having a first end 18,21 and a second end 19,22 which is pivotally attached to a respective bracket member 15,16, and also includes brace support members 23,24 each being securely and conventionally attached to a respective arm member 17,20 and each being adapted to removably mount to a rail 30 of a ladder 29. Each of the brace support members 23,24 has a first end wall 25, at least one side wall 26, an open second end 27, and a bore 28 extending through the open second end 27 and into the brace support member 23,24. Each of the brace support members 23,24 is adapted to be mounted upon a top end 31 of a respective rail 30 of the ladder 29 with the bore 28 being adapted to removably receive the top end 31 of a respective rail 30 of the ladder 29 therein. Each of the arm members 17,20 extends at an angle from a respective brace support member 23,24 relative to a longitudinal axis thereof with the first end 18,21 of the arm member 17,20 being integrally attached to the at least one side wall 26 of the brace support member 23,24 with each of the brace support members 23,24 being essentially a cylindrical member.

In use, prior to mounting a ladder 29 against a wall structure 32, the user would mount the protective ladder attachment 10 about the top ends 31 of the rails 30 of the ladder 29 and then rest the elongate brace member 11 against the wall structure 32 rather than the ladder 29 itself with the protective padded cover 14 resting against the wall structure 32.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable

I claim:

1. A protective ladder attachment for attaching onto a ladder having a pair of side rails with ends, said attachment comprising:

an elongate brace member having a first side and a second side;

a protective padded cover securely attached to said second side of said elongate brace member and being adapted to rest against a wall structure;

bracket members being spaced apart and securely attached to said first side of said elongate brace member; and a pair of rail receiving members each having opposed inner and outer faces, each said rail receiving members being adapted to removably receive an end of one of the side rails of the ladder, each said rail receiving member having a perimeter side wall defining an open end for receiving the end of the side rail and a channel for surrounding an end portion of the side rail, each said rail receiving member having a closed end mounted on said perimeter wall opposite said open end for preventing movement of the end of the side rail through said rail. receiving member; and arm members each having a first end and a second end which is pivotally attached to a respective one of said bracket members, said arm members being mounted at said first ends to said inner face of a respective one of said rail receiving members.

2. A protective ladder attachment as described in claim 1, wherein said protective padded cover comprises a rubber material for substantially preventing any damage to the wall structure.

3. A protective ladder attachment as described in claim 1, wherein each of said arm members extends at an angle from a respective said rail receiving member relative to a longitudinal axis thereof with said first end of said arm member being integrally attached to said at least one side wall of said rail receiving member.

4. A protective ladder attachment comprising:

an elongate brace member having a first side and a second side and further having a length of approximately 24 inches, and a width of approximately 8 inches and a depth of approximately 8 inches;

a protective padded cover securely attached to said second side of said elongate brace member and being adapted to rest against a wall structure, said protective padded cover being essentially made of a rubber material for substantially preventing any damage to the wall structure;

bracket members being spaced apart and securely attached to said first side of said elongate brace member; and a pair of rail receiving members each having opposed inner and outer faces, each said rail receiving members being adapted to removably receive an end of one of the side rails of the ladder, each said rail receiving member having a perimeter side wall defining an open end for receiving the end of the side rail and a channel for surrounding an end portion of the side rail, each said rail receiving member having a closed end mounted on said perimeter wall opposite said open end for preventing movement of the end of the side rail through said rail receiving member;

arm members each having a first end and a second end which is pivotally attached to a respective said bracket member, said arm members being mounted at said first ends to said inner face of a respective one of said rail receiving members; and wherein each of said arm members extends at an angle from a respective said rail receiving member relative to a longitudinal axis thereof with said first end of said arm member being integrally attached to said at least one side wall of said rail receiving member.

* * * * *